US009986339B2

(12) United States Patent
Lembacher et al.

(10) Patent No.: US 9,986,339 B2
(45) Date of Patent: May 29, 2018

(54) STIFFENING PLATE FOR ACOUSTIC MEMBRANE AND METHOD OF MANUFACTURING SAME

(71) Applicant: Sound Solutions International Co., Ltd., Beijing (CN)

(72) Inventors: Christian Lembacher, Gramatneusiedl (AT); Armin Timmerer, Vienna (AT); Hüdaverdi Ergül, Ternitz (AT); Murat Polat, Vienna (AT)

(73) Assignee: Sound Solutions International Co., Ltd., Beijing (CN)

( * ) Notice: Subject to any disclaimer, the term of this patent is extended or adjusted under 35 U.S.C. 154(b) by 0 days. days.

(21) Appl. No.: 15/280,329

(22) Filed: Sep. 29, 2016

(65) Prior Publication Data

US 2017/0094414 A1 Mar. 30, 2017

Related U.S. Application Data

(60) Provisional application No. 62/234,573, filed on Sep. 29, 2015.

(51) Int. Cl.

| | |
|---|---|
| ***H04R 25/00*** | (2006.01) |
| ***H04R 7/26*** | (2006.01) |
| ***H04R 31/00*** | (2006.01) |
| *H04R 9/06* | (2006.01) |
| *H04R 7/10* | (2006.01) |

(52) U.S. Cl.

CPC ..... *H04R 7/26* (2013.01); *H04R 31/003* (2013.01); *H04R 7/10* (2013.01); *H04R 9/06* (2013.01); *H04R 2307/204* (2013.01)

(58) Field of Classification Search

CPC combination set(s) only.

See application file for complete search history.

(56) References Cited

U.S. PATENT DOCUMENTS

| | | | | |
|---|---|---|---|---|
| 5,182,846 | A | 2/1993 | Tomita et al. | |
| 2004/0081326 | A1* | 4/2004 | Michiels | H04R 17/00 381/190 |
| 2006/0249327 | A1 | 11/2006 | Sato et al. | |
| 2010/0135519 | A1* | 6/2010 | Werners | G10K 9/12 381/398 |

(Continued)

FOREIGN PATENT DOCUMENTS

| | | | |
|---|---|---|---|
| CN | 201590895 | U | 9/2010 |
| CN | 101919269 | A1 | 12/2010 |

(Continued)

OTHER PUBLICATIONS

International Search Report and Written Opinion of ISA, Int'l Appl. No. PCT/CN2016/100786, dated Jan. 5, 2017.

*Primary Examiner* — Amir Etesam

(74) *Attorney, Agent, or Firm* — Steven McMahon Zeller; Dykema Gossett PLLC

(57) ABSTRACT

A method of thinning a multilayer laminate material used for a membrane stiffening plate is provided to obtain a membrane stiffening plate having a thickness less than currently known in the art. The method provides for a significant reduction in the thickness of a membrane stiffening plate and provides for a mechanism to tune the cut-off frequency of a loudspeaker on which the membrane stiffening plate is used.

13 Claims, 8 Drawing Sheets

(56) References Cited

U.S. PATENT DOCUMENTS

| | | | | |
|---|---|---|---|---|
| 2012/0093353 | A1* | 4/2012 | Windischberger ..... | H04R 1/22<br>381/396 |
| 2015/0016639 | A1 | 1/2015 | He | |
| 2017/0050408 | A1* | 2/2017 | Park ..... | B29C 44/02 |

FOREIGN PATENT DOCUMENTS

| | | | |
|---|---|---|---|
| CN | 203378029 | U | 1/2014 |
| EP | 1513369 | A2 | 9/2005 |
| EP | 2239959 | A1 | 10/2010 |
| JP | 2001024460 | A | 1/2001 |

* cited by examiner

STIFFENING PLATE FOR ACOUSTIC MEMBRANE AND METHOD OF MANUFACTURING SAME

BACKGROUND OF THE INVENTION a. Field of the Invention

This invention relates to electro-acoustic transducers, for example micro speakers for use in reproducing sound in microelectronic equipment such as mobile phones, tablets, digital music players, navigation systems, laptop computers and the like. In particular, the invention relates to a stiffening plate for the membrane of an electro-acoustic transducer and a method of manufacturing such a stiffening plate.

b. Background Art

Electro-acoustic transducers used in microelectronic equipment have the ever increasing requirements of improved acoustic performance and decreased size of said transducers. The two requirements are often in conflict.

In miniature loudspeaker applications, where a membrane is driven by a voice coil, a low resonance frequency of the membrane is desired for obtaining good sound reproduction across a wide frequency range. A low resonance frequency can be achieved with a thin membrane having a relatively low Young's modulus. However, speakers with such membranes may have a low first break-up frequency, that is, the frequency at which a membrane may bulge and stop moving as a rigid piston. At the break-up frequency, a peak occurs in the frequency response representing a decreased performance of the speaker.

A known method of adjusting the first break-up frequency of a membrane is to provide damping by affixing a stiffening plate on top of the membrane. The material used for the plate must provide stiffness in order to increase the first break-up frequency, but must also be light weight to maintain the sensitivity of the membrane and not impact the loudness of the speaker. Composite stiffening plates, typically made of a polymer foam layer bonded between two metal layers by an adhesive, are known to have the necessary stiffness and low weight to provide effective damping to a membrane.

However, a desire for a smaller transducer, and in particular for one having a lower profile, cannot be met with known stiffening plates. Currently known commercially available composite stiffening plate material has a minimum thickness of 120 μm, the majority of which is the polymer foam layer. For a typical miniature loudspeaker, this may be 10 times more than the thickness of the membrane. There is a need, therefore, for a membrane stiffening plate with sufficient stiffness to provide damping to a membrane, of low weight and thinner than current known materials.

SUMMARY OF THE INVENTION

It is an object of the invention to provide a membrane stiffening plate that improves the performance of a membrane and offers a reduced thickness to meet the needs of smaller transducers.

In order to achieve the objective defined above, a method of manufacturing a membrane stiffening plate and a membrane stiffening plate according to the embodiments described herein are provided.

The method of manufacturing a membrane stiffening plate according to one aspect of the invention comprises the steps of constructing a multilayer laminate comprising a middle layer of a polymer foam sandwiched between two layers of a stiff material such as a metal, the stiff material layers affixed to opposite sides of the polymer foam layer with a bonding layer, the multilayer laminate having a thickness between 120 μm and 330 μm, wherein the thickness of each stiff material layer is typically between 6 μm and 40 μm. The method further comprises compressing, without applying heat, the multilayer laminate in the direction of its thickness for a pre-determined time to achieve a thickness of less than 75% of the original thickness of the laminate.

In another embodiment, the method of manufacturing a membrane stiffening plate comprises applying compression without heat to a sheet of a polymer foam having a thickness between 120 μm and 170 μm, for a pre-determined time to achieve a thickness of between 65% to 75% of the original thickness, and constructing a multilayer laminate by affixing a stiff material layer, such as a metal, to each side of the compressed polymer foam with a bonding layer.

According to another aspect of the invention, a multilayer membrane stiffening plate is provided comprising a layer of polymer foam, a first metal layer affixed to a first side of the polymer foam layer with bonding layer, and a second metal layer affixed to a second side of the polymer foam, opposite the first side, with a bonding layer. In an embodiment, the polymer foam has been compressed, without added heat, to a thickness of less than 75% of its original thickness of between 120 μm and 330 μm before the first and second metal layers are affixed to the polymer foam. In another embodiment, the multi-layer membrane stiffening plate has been compressed, without added heat, to a thickness between 65% to 75% of its original thickness of between 120 μm and 170 μm.

According to an exemplary embodiment an electro-acoustic transducer is provided, wherein the electro-acoustic transducer comprises a membrane, a coil fixed to the membrane on a first side, and a membrane stiffening plate according to an exemplary embodiment affixed to the membrane opposite the coil. In particular, the electro-acoustic transducer is a miniature loudspeaker.

For purposes of the present disclosure, the term "polymer foam" particularly donates a foamed thermoplastic material having a closed-cell microstructure.

The term "thermoplastic" defines a material capable of softening when heated to change shape and capable of hardening when cooled to keep shape. This property may be maintained repeatedly, even after a plurality of heating/cooling cycles.

The term "electro-acoustic transducer" particularly denotes any apparatus which is capable of generating sound for emission to an environment and/or detecting sound present in the environment. Such an acoustic device particularly includes any electromechanical transducer capable of generating acoustic waves based on electric signals, or vice versa.

The term "acoustically damping" particularly denotes a material property which makes is possible to selectively damp acoustic waves. Particularly, such an acoustically damping member can damp standing waves on a diaphragm.

The term "membrane" may particularly denote any kind of element adapted or suitable for performing an oscillating movement and thus may be able to generate or detect air movement or sound waves.

The term "stiffness" may particular denote a characteristic of an element describing the resistance of the element against deformation or deflection. That is, a material or element having a higher stiffness may have a smaller deflection than a material or element having a smaller stiffness when exposed to the same force trying to deflect or move the element.

The exemplary embodiments and aspects defined above and further aspects of the invention are apparent from the examples of embodiment to be described hereinafter and are explained with reference to these examples of embodiment. Features which are described in the connection with one exemplary embodiment or exemplary aspect may be combined with features of another exemplary embodiments or aspects.

The foregoing and other aspects, features, details, utilities, and advantages of the present invention will be apparent from reading the following description and claims, and from reviewing the accompanying drawings.

BRIEF DESCRIPTION OF THE DRAWINGS

Further embodiments of the invention are indicated in the figures and in the dependent claims. The invention will now be explained in detail by the drawings. In the drawings:

The illustration in the drawing is schematically. In different drawings, similar or identical elements are provided with the same reference signs.

DETAILED DESCRIPTION OF EMBODIMENTS

Various embodiments are described herein to various apparatuses. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments," "one embodiment," or "an embodiment," or the like, means that a particular feature, structure, or characteristic described in connection with the embodiment is included in at least one embodiment. Thus, appearances of the phrases "in various embodiments," "in some embodiments," "in one embodiment," or "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features, structures, or characteristics of one or more other embodiments without limitation given that such combination is not illogical or non-functional.

Figure 1:
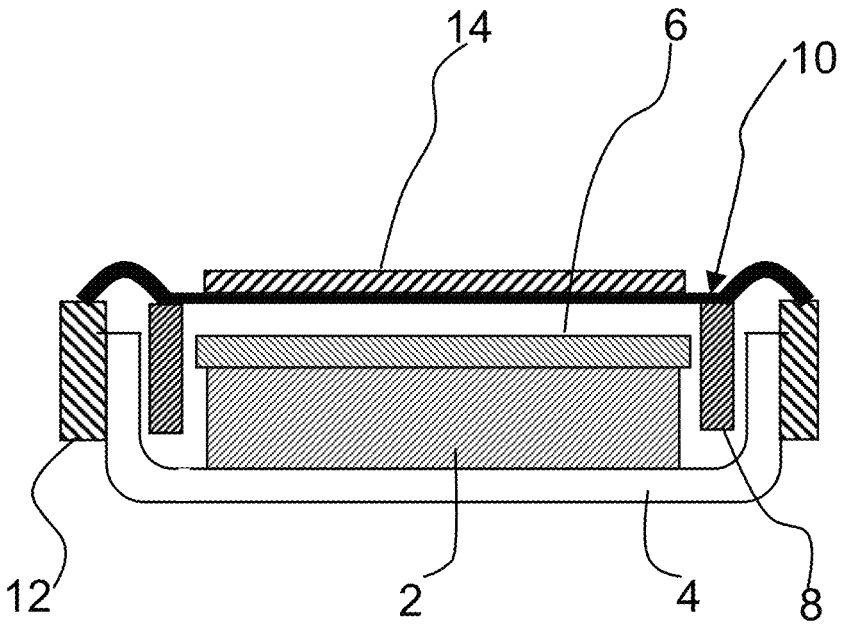
FIG. 1 shows a known speaker configuration in which a membrane stiffening plate of one embodiment of the invention can be employed.

FIG. 1 schematically illustrates the structure of a general dynamic micro-speaker, which is one type of electro-acoustic transducer that the membrane stiffening plate of the present invention can be applied. In this embodiment, the speaker comprises a magnetic circuit for generating magnetic flux, a vibration system that vibrates due to repulsive force against the magnetic flux acting on the magnetic circuit, and a main body. The magnetic circuit comprises a permanent magnet 2, a yoke 4 with the permanent magnet 2 contained therein, and an upper plate 6 attached to an upper surface of the permanent magnet 2.

The vibration system comprises a voice coil 8 fitted into a gap between the permanent magnet 2 and the inner diameter of the yoke 4. The voice coil 8 generates the magnetic flux when an electric current is driven into the coil. The electrical connections to the coil are not shown. The speaker membrane 10 is bonded to the voice coil 8. The speaker has a main body in the form of a frame 12 to which the membrane 10 is fixed. A membrane stiffening plate 14 is provided on (and bonded to) the membrane 10 on the opposite side to the coil 8. The membrane stiffening plate 14 is formed from a multilayer laminate material that has been thinned per the embodiments described below.

Figure 2:
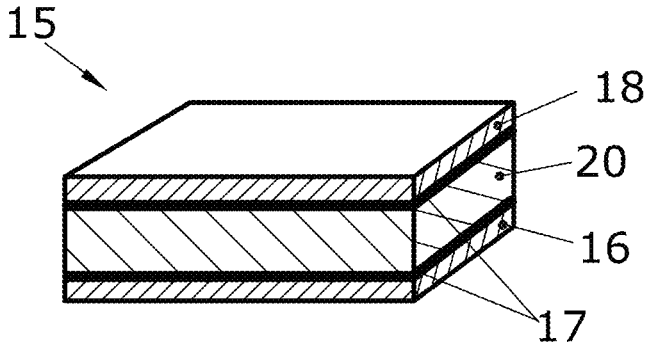
FIG. 2 shows a cross-sectional view of a multilayer laminate material from which a membrane stiffening plate according to one aspect of the present invention can be constructed.

FIG. 2 shows a cross-sectional view of an unpressed multilayer laminate material 15 from which membrane stiffening plate 14 is formed after it has been thinned according to one aspect of the invention. The unpressed multilayer laminate material 15 is comprised of multiple layers of different materials. In this example embodiment, unpressed multilayer laminate material 15 is comprised of two outer metal layers 16, 18 and an inner layer of polymer foam 20. In an embodiment, the outer metal layers 16, 18 are of the same metal, in this embodiment aluminum. In other embodiments, the metal outer layers 16, 18 can be made of a different metal such as steel. In further embodiments, outer layers 16, 18 can be of different metals from each other. Metal outer layers 16, 18 are affixed to the opposite sides of the polymer foam 20 by a bounding layer 17.

Unpressed multilayer laminate material 15 can be commercial obtained in the finished form or can be manufactured using commercially available materials. As shown in FIG. 2, the polymer foam 20 comprises the majority of the thickness of the entire unpressed multilayer laminate material 15. For example, the typical thickness of the outer metal layers 16, 18 is between 6 μm and 40 μm, while the overall thickness of the entire unpressed multilayer laminate material 15 is about 330 μm. The thinnest commercially available unpressed multilayer laminate material suitable as a membrane stiffening plate is 120 μm.

Since it is desirable, and sometime required, to decrease the overall profile of an electro-acoustic transducer, reductions in the thickness of all components are investigated. Since it is known that a thermoplastic material can usually be thinned by applying pressure and heat, such technique was considered for use on the unpressed multilayer laminate material 15 to reduce the thickness of membrane stiffening plate 14, both on the unpressed multilayer laminate material 15 and on just the polymer foam 20 before being bonded to the outer metal layers 16, 18. However, the process of thinning a thermoplastic by applying pressure and heat adds an undesired complexity to the manufacturing process, as well as an unacceptable amount of additional time that is required to heat the material to the desired temperature and allow it to cool after being processed. Further, in considering the technique for the multilayer laminate material 15, it was thought that the additional added heat would have a detrimental impact on the bonding layer 17, causing a degradation to the bond between the outer metal layers 16, 18 and the polymer foam 20.

The inventors discovered that pressure without the addition of heat, applied for a very short period of time (i.e., less than 1 second), surprisingly achieved the desired thinning of the multilayer laminate material 15 and provided a stable product as evidenced by lifetime simulation tests. It was particularly surprising given that the polymer foam 20 had a closed pore microstructure. One would expect that for a foam with an open pore microstructure, it would be expected that the air would be able to escape the foam material during pressing and the foam would remain deformed, or thinned. However, for a foam having a closed pore microstructure, one would expect that air would be trapped within the foam by the cell walls, thus preventing the foam from compressing, or at least remaining compressed with only pressure and no heat applied.

Figure 3:
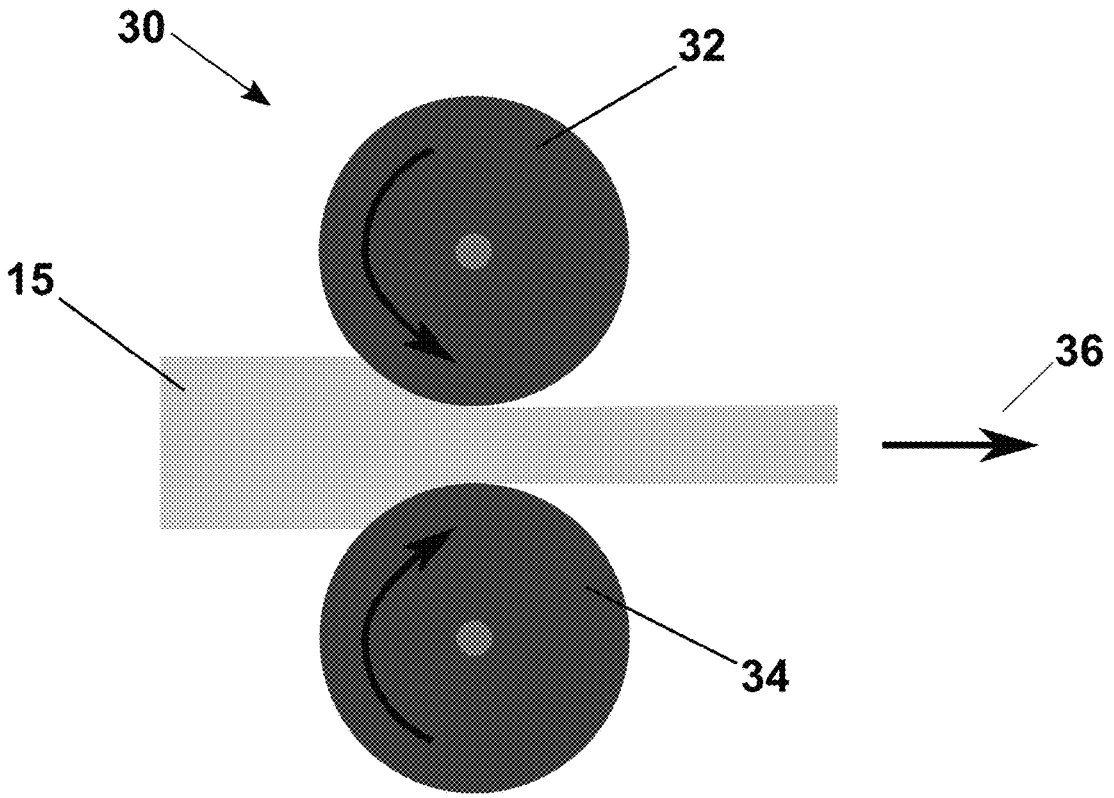
FIG. 3 shows a side view schematic of a process of applying pressure to a multilayer laminate material according to one aspect of the invention.

FIG. 3 shows a side view schematic of the process of thinning the multilayer laminate material 15 by applying pressure according to one embodiment. In the process, a strip of multilayer laminate material 15 is fed into roller machine 30 comprising an upper roller 32 and a lower roller 34. In the embodiment, the upper and lower rollers 32, 34 are shown as being the same size but roller machine 30 is not so limited. Upper roll 32 rotates counter-clockwise while lower roll 34 rotates clockwise, forcing the strip of multilayer laminate material 15 to move in the direction of arrow 36. In an embodiment, the speed of the rollers is set such that the strip of multilayer laminate material 15 goes through the rollers at a speed of 3 cm/s.

Figure 4:
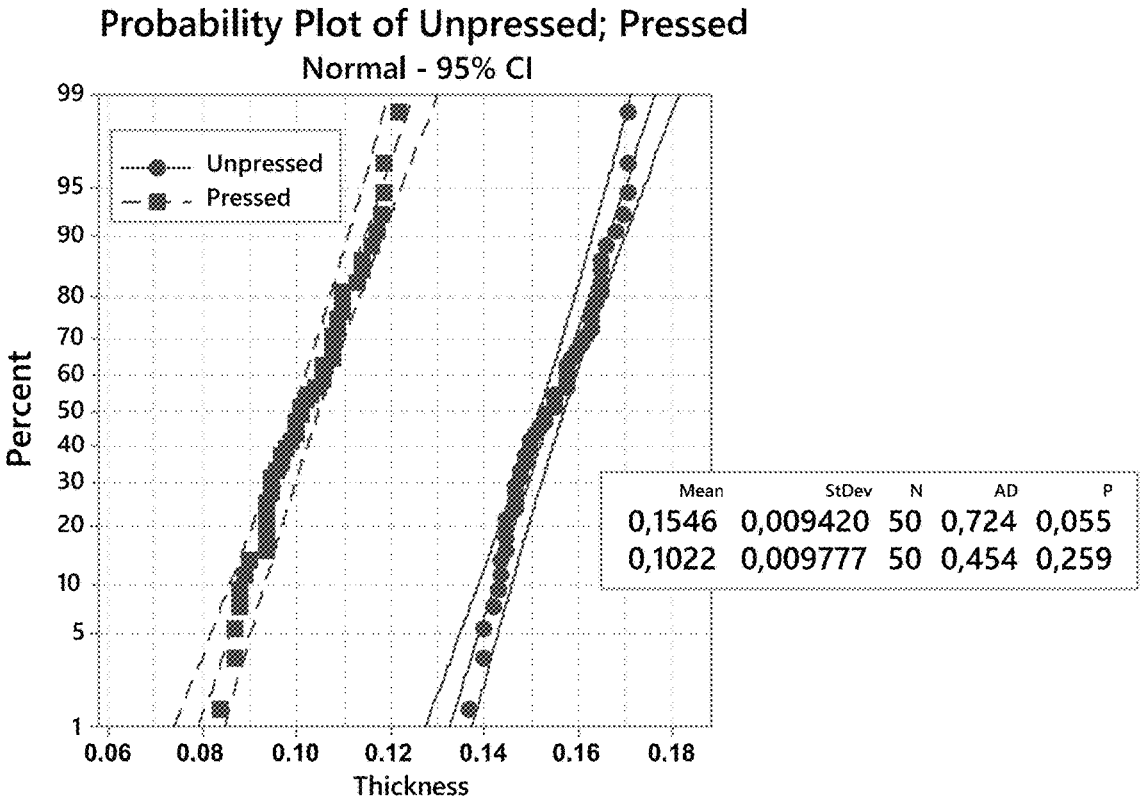
FIG. 4 shows a probability plot of the thickness of multiple samples of a multilayer laminate material prior to and after being compressed according to one aspect of the present invention.

The above steps of applying pressure to the multilayer laminate material 15 was performed on fifty (50) different samples of the same multilayer laminate material 15 to investigate the consistency of the process in obtaining a uniform thickness. The thickness of each sample was measured both before and after the sample was compressed by the process above. FIG. 4 is a probability plot of the sample thicknesses. On the right are the thickness measurements before compression and on the left are the thicknesses measurements after compression. The mean sample thickness before compression was 154.6 μm, with a standard deviation of 9.4 μm at the 95% confidence level. After compression, the mean sample thickness was 102.2 μm, with a standard deviation of 9.8 μm.

Figure 5:
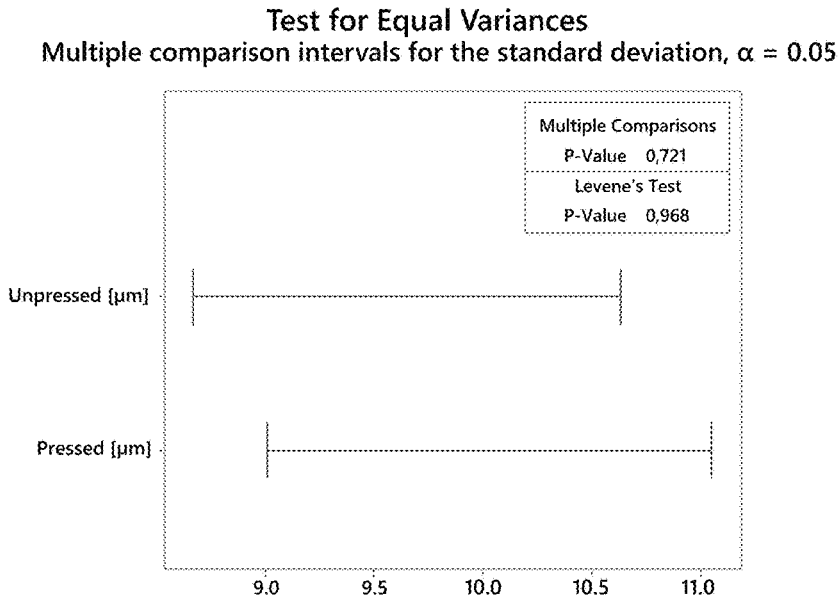
FIG. 5 shows the result of a test for equal variances from a comparison of the distribution of thicknesses analyzed in the plot of FIG. 4.

The steps of applying pressure described above produced surprisingly consistent results in thinning of the multilayer laminate material 15. In particular, as shown in FIG. 4, the thickness distribution for the samples after compression is similar to the samples before compression. FIG. 5 is a graph showing the results of a test for equal variances using the multiple comparisons method. The results show that there is statistically no difference in the thickness variance between unpressed and pressed multilayer laminate material.

The inventors further discovered a loudspeaker having a membrane stiffening plate 14 made from the pressed multilayer laminate material 15 has a changed sound pressure level (SPL) curve from the same speaker having a membrane stiffening plate 14 made from the unpressed multilayer laminate material 15. This result is surprising given that the weight of the multilayer laminate material 15 does not change as a result of the compression process.

Figure 6:
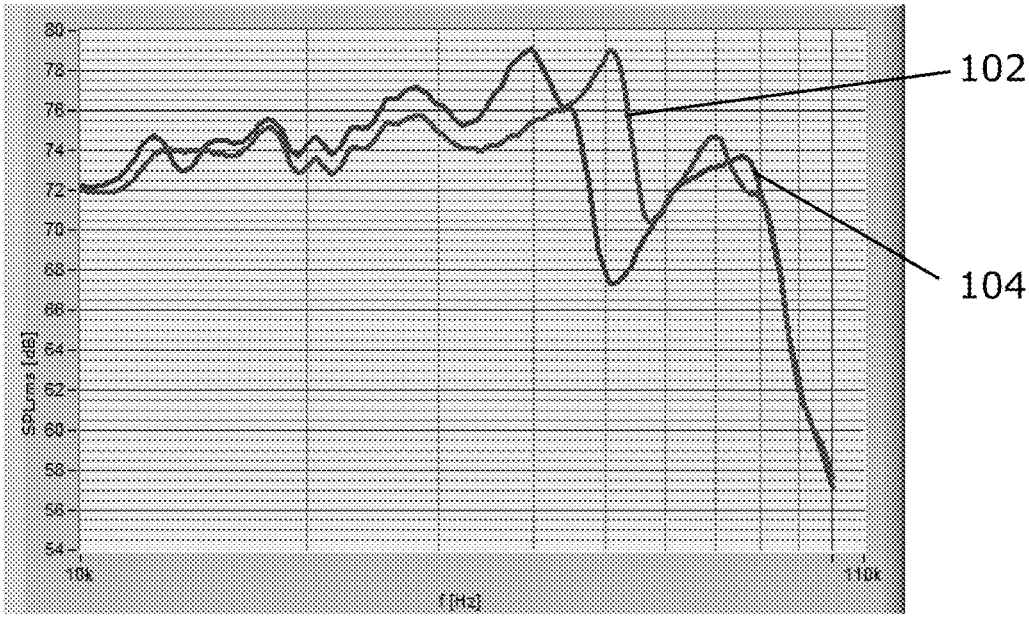
FIG. 6 shows a graph of the sound pressure curve for a loudspeaker comprising a membrane stiffening plate before and after compression has been applied according to one aspect of the present invention.

For example, FIG. 6 shows a graph of the SPL over a frequency range for a loudspeaker with a membrane stiffening plate made from both an unpressed multilayer laminate material 15 (curve 102) and from a pressed multilayer laminate material 15 (curve 104). As shown, the highest sound pressure on curve 102, for the unpressed multilayer laminate material 15, occurs at about 50 kHz, while the highest sound pressure on curve 104, for the pressed multilayer laminate material 15, occurs at about 40 kHz. Thus, the process of thinning the multilayer laminate material 15 can be used to tune the maximum sound output for a given speaker.

Figure 7:
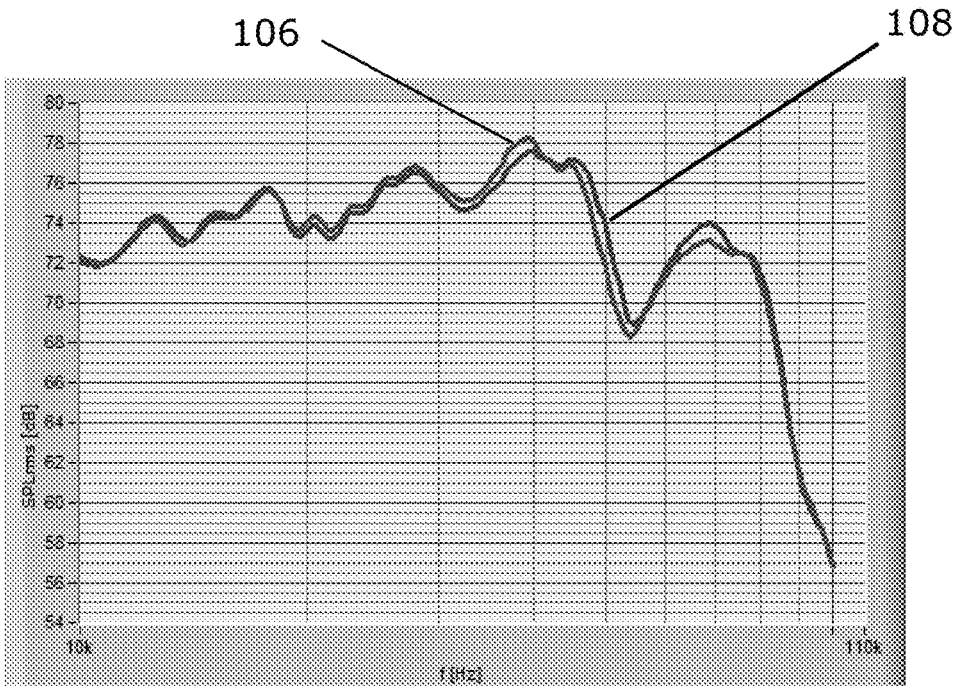
FIG. 7 shows a graph of the sound pressure curve for a loudspeaker comprising a membrane stiffening plate after compression has been applied, both before and after a reliability test has been performed.

Surprisingly the thickness of the pressed plate has turned out to be stable in all standard speaker reliability tests, and therefore also the acoustic behavior of the speaker does not change during reliability testing. As an example, FIG. 7 shows the SPL curves before (curve 106) and after (curve 108) a heat storage test at 85° C. and for 168 hours. The response of the speaker is little changed.

Figure 8:
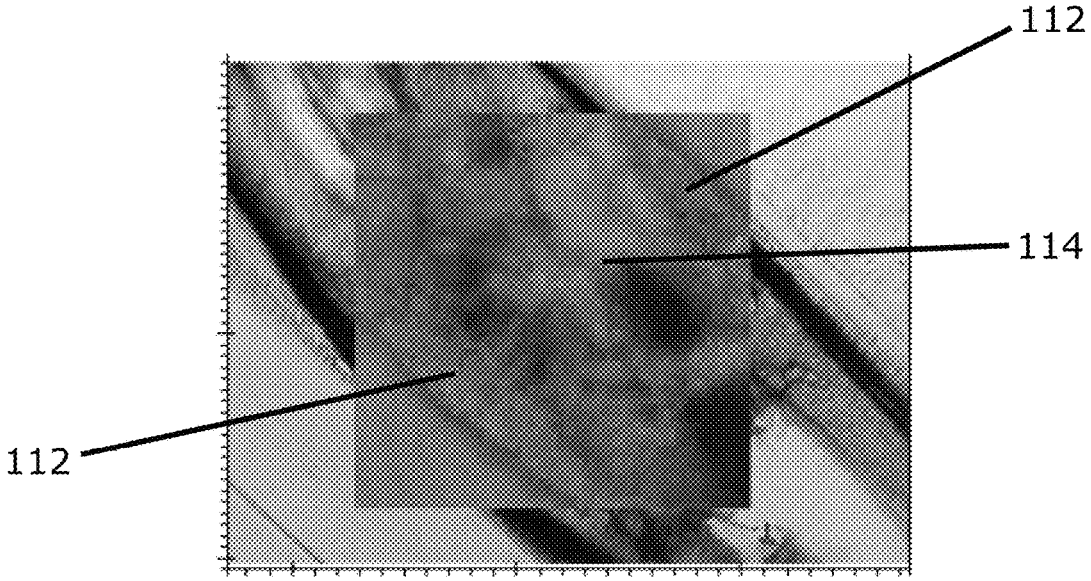
FIG. 8 shows a microscopic image of a cross section of an unpressed multilayer laminate material according to one aspect of the present invention, with a chemical analysis image of the material superimposed thereon.
Figure 9:
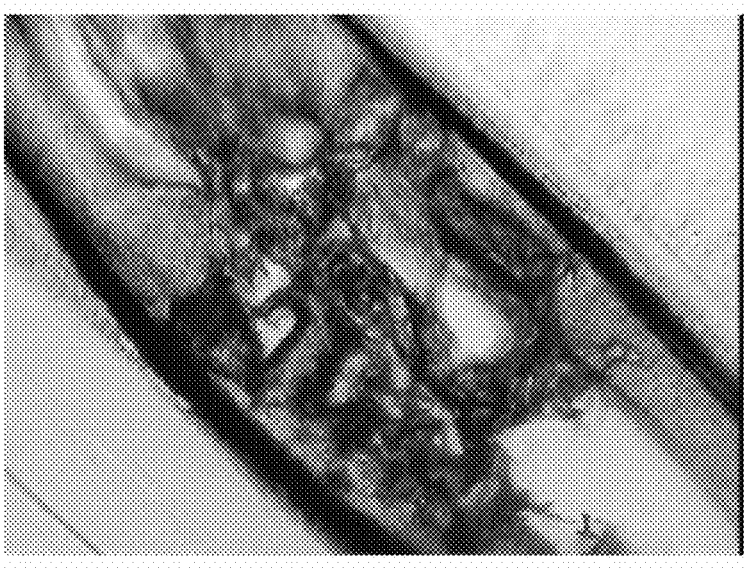
FIG. 9 shows the microscopic image of FIG. 8 without the chemical analysis image superimposed.
Figure 10:
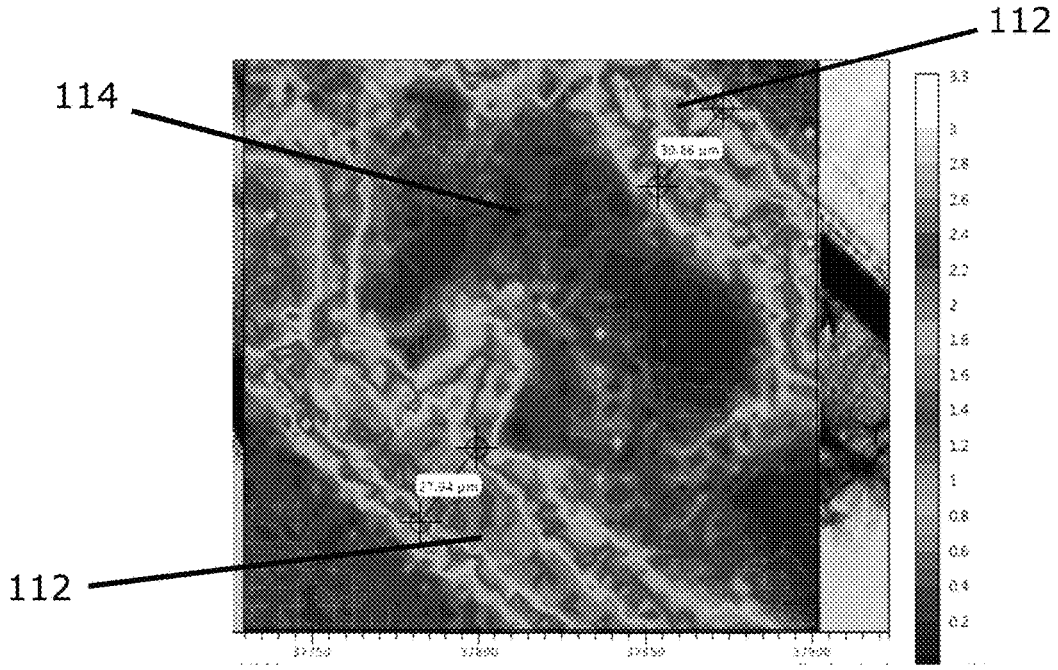
FIG. 10 shows an enlarged view of the chemical analysis shown in FIG. 8, with indications of measurements thereon.

The structural change in the multilayer laminate material after the compression process was investigated. FIGS. 8 and 9 show microscopic imaging of a cross section of unpressed multilayer laminate material 15. In FIG. 8, a chemical analysis image of the material is superimposed on the image of FIG. 9. The polymer foam 20 is represented by area 114 on FIG. 8, while the bands 112 on either side of area 114 represent the bonding layer 17 between the polymer foam 20 and the stiff metal layers 16, 18. Measurements on the chemical analysis image revealed that the bands 112, i.e., bonding layers 17, were approximately 30 μm, as shown in FIG. 10.

Figure 11:
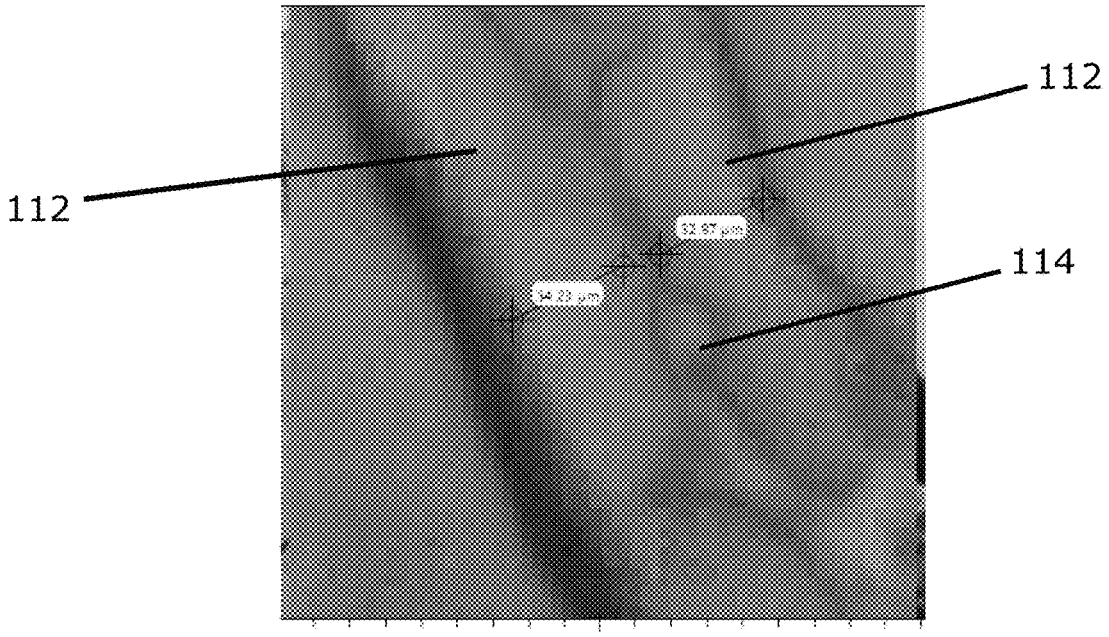
FIG. 11 shows a chemical analysis image of the compressed multilayer laminate material according to one aspect of the present invention, with indications of measurements thereon.

Similar imaging and measurements were taken of a cross section of the multilayer laminate material 15 after it had been compressed in the process described above. FIG. 11 shows the chemical analysis image of the pressed multilayer laminate material 15. The bands 112 of the bonding layers 17 still had a thickness of approximately 30 μm. In contrast, area 114, the polymer foam 20, has become very thin. The conclusion is that the bonding layer between the polymer foam 20 and outer metal layers 16, 18 stays basically the same after the compression process, while most of the thinning happens to the polymer foam 20.

Figure 12:
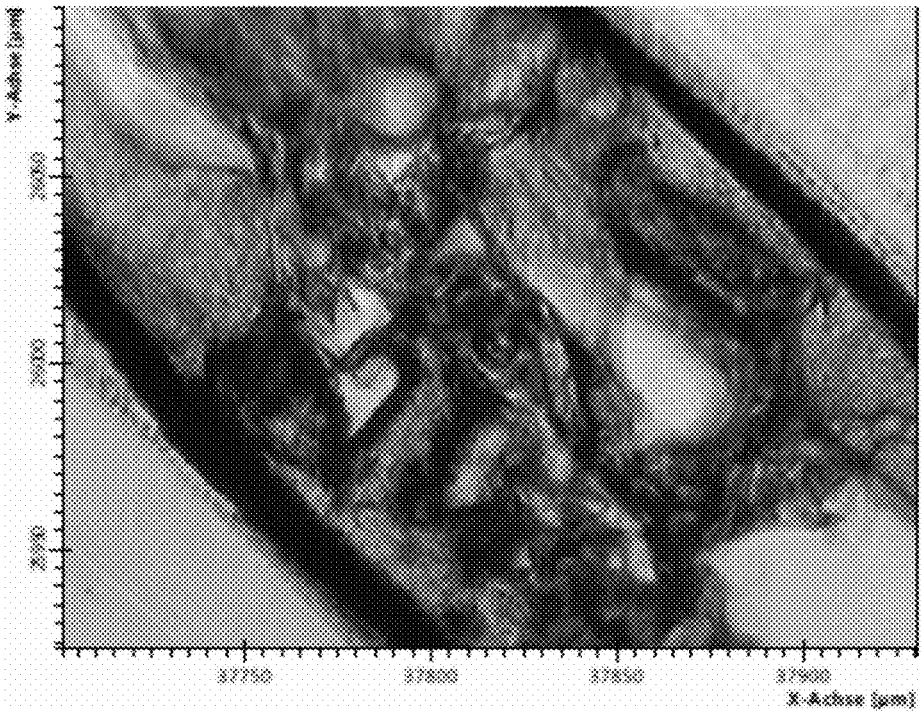
FIG. 12 is an enlarged view of the microscopic image of FIG. 9.
Figure 13:
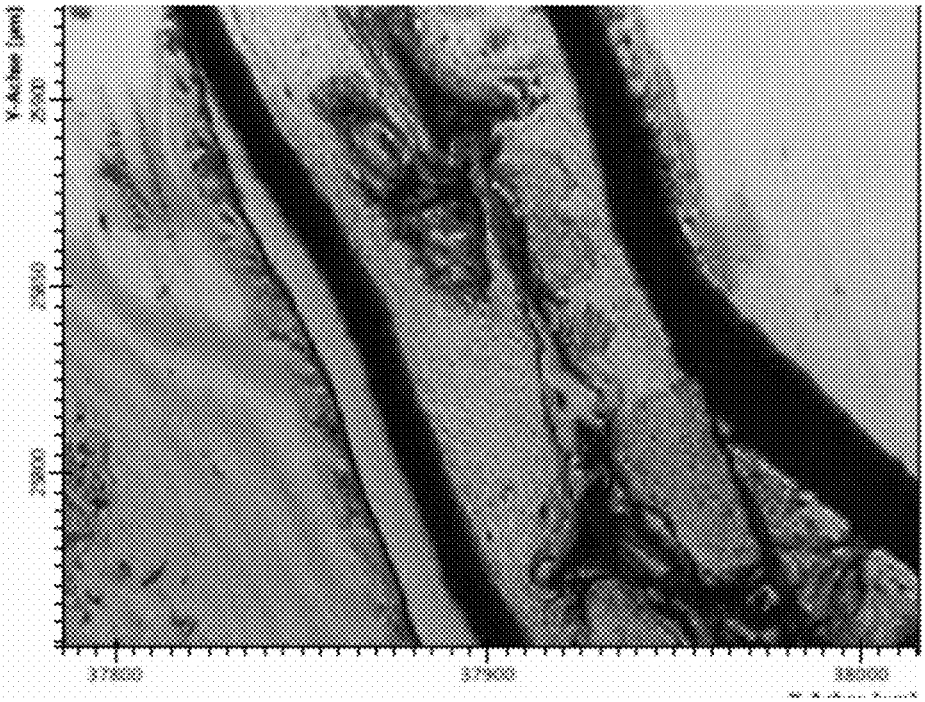
FIG. 13 shows a microscopic image of the compressed multilayer laminate material shown in FIG. 11.
Figure 14:
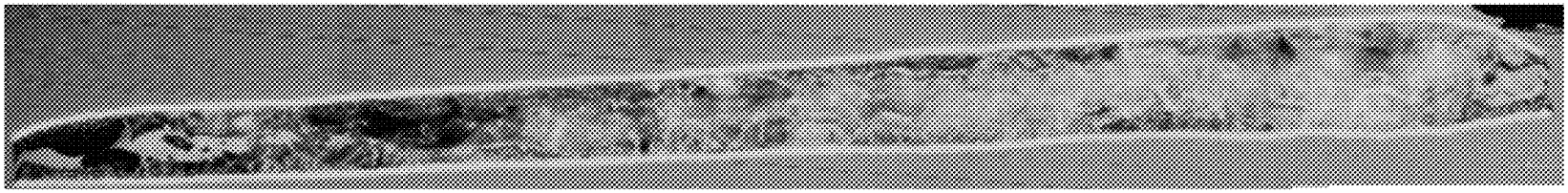
FIG. 14 shows a cross-sectional view along the entire width of an unpressed sample of a multilayer laminate material from which a membrane stiffening plate according to another aspect of the present invention can be constructed.
Figure 15:
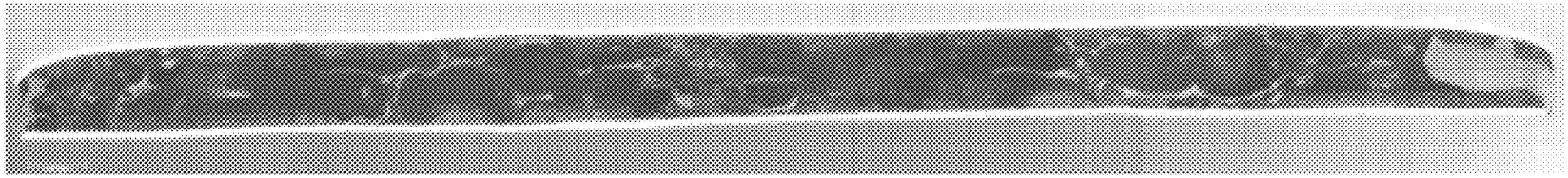
FIG. 15 shows a cross-sectional view along the entire width of a compressed sample of a multilayer laminate material of the same type as shown in FIG. 13.

FIGS. 12 and 13 show microscopic imaging of the unpressed and compressed multilayer laminate material 15, respectfully. FIGS. 14 and 15 show further imaging of the structural difference between unpressed and compressed multilayer laminate material 15, respectfully, along the cross-sectional length of the sample.

It should be noted that the invention is related to electroacoustic transducers in general, which means to speakers as well as microphones, even though reference is mostly made to speakers.

It should be noted that the invention is not limited to the above mentioned embodiments and exemplary working examples. Further developments, modifications and combinations are also within the scope of the patent claims and are placed in the possession of the person skilled in the art from the above disclosure. Accordingly, the techniques and structures described and illustrated herein should be understood to be illustrative and exemplary, and not limiting upon the scope of the present invention. The scope of the present invention is defined by the appended claims, including known equivalents and unforeseeable equivalents at the time of filing of this application.

What is claimed is:

1. An electroacoustic transducer comprising:

a magnetic circuit for generating a magnetic flux comprising a yoke, a permanent magnet contained within the yoke and an upper plate attached to an upper surface of the permanent magnet;

a voice coil surrounding the permanent magnet and configured to oscillate in a gap between the permanent magnet and the yoke;

a membrane affixed to the voice coil on one side; and a membrane stiffening plate affixed to the membrane on the side opposite the voice coil, the membrane stiffening plate comprising:

a middle layer substantially comprised of a polymer foam;

a first outer layer comprised of a metal and disposed on a first side of the middle layer;

a second outer layer comprised of a metal and disposed on a second side of the middle layer, the second side being opposite the first side; and first and second bonding layers disposed between the respective first and second outer layers and the middle layer, the bonding layers comprised of an adhesive and configured to affix the outer layers to the middle layer, wherein the membrane stiffening plate has been compressed without being subjected to heat such that the thickness of the membrane stiffening plate has been reduced by about 65% to about 75% of its thickness before compression.

2. The electroacoustic transducer of claim 1, wherein the first outer layer and the second outer layer are comprised of the same metal.

3. The electroacoustic transducer of claim 2, wherein the first outer layer and the second outer layer are both comprised of aluminum.

4. The electroacoustic transducer of claim 1, wherein one or both of the first and second outer layers are comprised of aluminum.

5. The electroacoustic transducer of claim 1, wherein before compression, the thickness of the middle layer is more than half the total thickness of the membrane stiffening plate.

6. The electroacoustic transducer of claim 5, wherein before compression, the thickness of the middle layer is more than 70% of the total thickness of the membrane stiffening plate.

7. The electroacoustic transducer of claim 1, wherein the polymer foam has a closed pore microstructure.

8. The electroacoustic transducer of claim 1, wherein the membrane stiffening plate is manufactured by the steps of:

constructing a multilayer laminate comprising:

a layer of uncompressed polymer foam;

the first outer layer comprised of a metal and affixed to the first side of the uncompressed polymer foam by the first bonding layer; and the second outer layer comprised of a metal and affixed to the second side of the uncompressed polymer foam by the second bonding layer, the second side of the uncompressed polymer being opposite the first side; and applying pressure to the multilayer laminate in the direction of its thickness for a sufficient time to achieve a reduction in the thickness of the multilayer laminate of about 65% to about 75% of its thickness prior to applying pressure.

9. The electroacoustic transducer of claim 8, wherein the step of applying pressure is performed at room temperature and no heat is applied to the multilayer laminate during the step.

10. The electroacoustic transducer of claim 8, wherein pressure is applied to the multilayer laminate for less than one second.

11. The electroacoustic transducer of claim 8, wherein the step of applying pressure to the multilayer laminate is performed in a roller machine.

12. The electroacoustic transducer of claim 8, wherein the uncompressed polymer foam has a closed pore microstructure.

13. The electroacoustic transducer of claim 8, wherein after the step of applying pressure, the majority of the reduction in the thickness of the multilayer laminate is comprised of a reduction in the thickness of the polymer foam.

* * * * *